United States Patent [19]

Duris

[11] 4,231,167

[45] Nov. 4, 1980

[54] APPARATUS FOR HEAT TREATMENT OF CONTINUOUS TEXTILE PRODUCTS

[75] Inventor: Jean Duris, Habsheim, France

[73] Assignee: Societe Alsacienne de Constructions Mecaniques de Mulhouse, Mulhouse, France

[21] Appl. No.: 27,887

[22] Filed: Apr. 6, 1979

[30] Foreign Application Priority Data

Apr. 7, 1978 [FR] France ..... 78 10367

[51] Int. Cl.[3] ..... F26B 19/00

[52] U.S. Cl. ..... 34/66; 34/159; 34/216; 432/59

[58] Field of Search ..... 432/8, 59, 72, 207, 432/200, 201, 163, 167; 34/66, 159, 215–217

[56] References Cited

U.S. PATENT DOCUMENTS

| | | | |
|---|---|---|---|
| 3,411,217 | 11/1969 | Daley | 34/66 |
| 3,470,625 | 10/1969 | Chikamasa et al. | 34/159 |
| 3,837,790 | 9/1974 | Pierson | 432/8 |
| 4,116,620 | 9/1978 | Stibbe | 432/59 |
| 4,139,953 | 2/1979 | Gaskell | 34/159 |
| 4,148,946 | 4/1979 | Byrd et al. | 432/200 |

FOREIGN PATENT DOCUMENTS

| | | | |
|---|---|---|---|
| 812042 | 4/1959 | United Kingdom | 34/217 |

*Primary Examiner*—Henry C. Yuen

*Attorney, Agent, or Firm*—Cantor and Singer

[57] ABSTRACT

This invention relates to heat treatment of textile products.

The apparatus comprises vertical furnaces (5) each having two furnace ducts (29, 30) carrying blowing nozzles (36) and suction nozzles (37), respectively. In the ducts of the last furnace, there are arranged movable horizontal partitions formed by the selective closure of baffles (81-1, 81-2, ... 81-5, 91-1, 91-2, ... 91-4) arranged at fixed levels and preferably constituted by butterfly-valves (82) pivotally mounted on horizontal parallel axes (83).

The invention is applicable to the heat treatment of continuous textile products, such as threads, ribbon or strip material. (FIG. 4).

6 Claims, 4 Drawing Figures

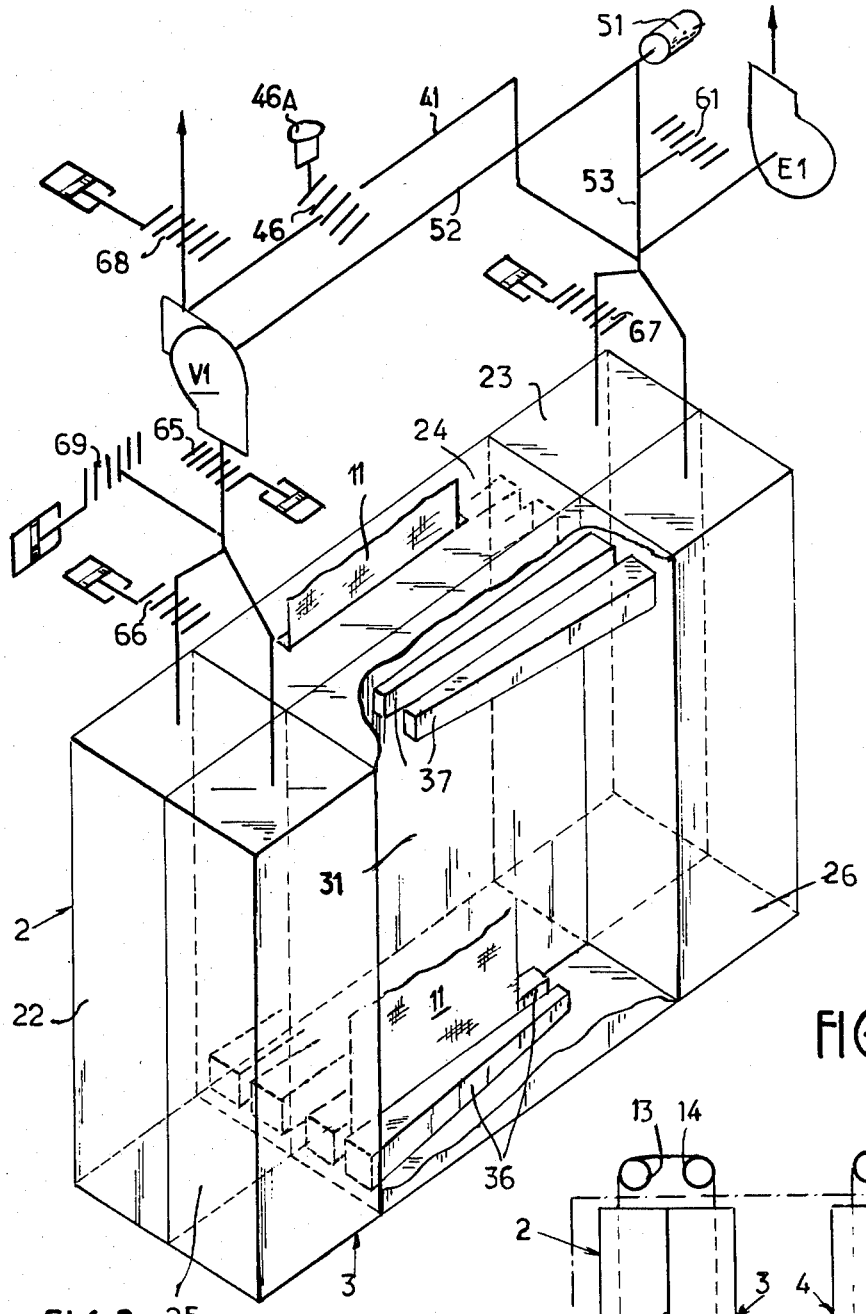
FIG.2
FIG.1
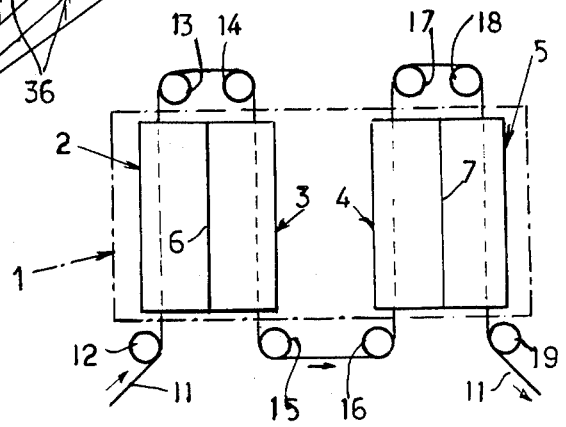

APPARATUS FOR HEAT TREATMENT OF CONTINUOUS TEXTILE PRODUCTS

BACKGROUND OF THE INVENTION

The invention relates to apparatus for heat treatment of continuous textile products, such as thread, ribbon or strip material, of the type having an arrangement of vertical furnaces through which the product passes successively upwardly and downwardly, between hot or cold air blowing nozzles and suction nozzles alternately supported in pairs, in cantilever fashion by two spaced vertical furnace ducts the upper parts of which are connected respectively to a blowing fan and an exhaust fan, the last furnace being provided with means adapted to form a height adjustable partition which divides each of the two ducts of this furnace into an upper hot air treatment zone and a lower cold air treatment zone, this latter zone being also equipped with a blowing fan and exhaust fan.

In known apparatus of this type, each of the said movable partitions is constituted by a slidable wall which is moved within the duct. An object of this invention is to provide apparatus in which the movable partitions are of a different construction which is easier to use.

To this end, according to the invention, the means adapted to form the said movable partition is constituted by a series of horizontal baffles vertically spaced within the corresponding duct and selectively operable such that one of said baffles in a closed position forms the partition in question, the other baffles being in the open position. Without having to move the position of the baffles, one can thus form a partition at any desired level, simply by closing the corresponding baffle at this level, whilst leaving the other baffles open.

The invention will be better understood by reading the following description and examining the attached drawings which show, by way of example, one embodiment of apparatus for heat treatment of strip material according to the invention.

BRIEF DESCRIPTION OF THE DRAWINGS

FIG. 1 shows schematically, in section, the arrangement of the apparatus,

FIG. 2 is a perspective view of a first half of the apparatus of FIG. 1,

DESCRIPTION OF THE PREFERRED EMBODIMENT

Figure 3:
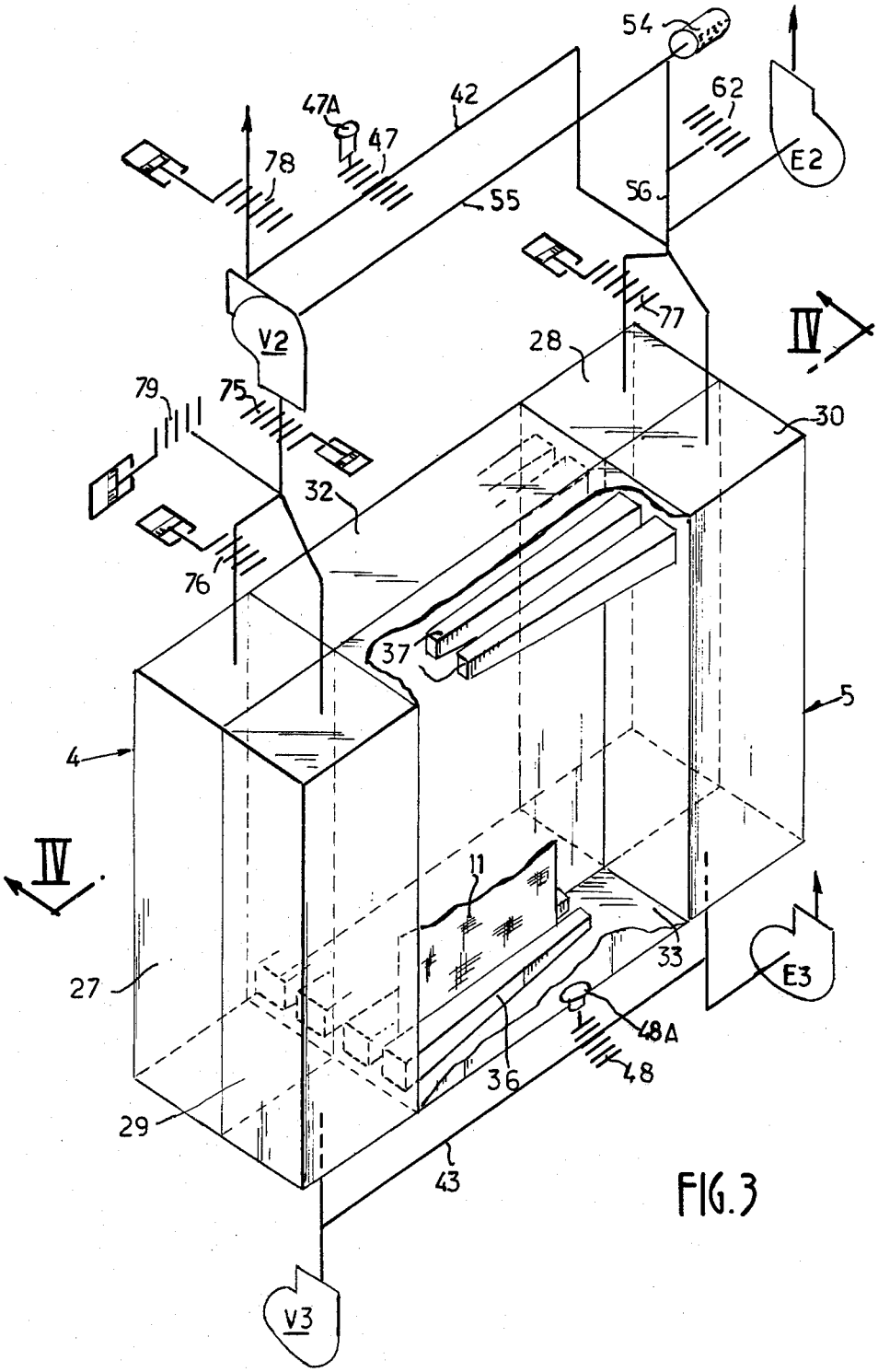
FIG. 3 is a perspective view of the second half of the apparatus.

The apparatus for heat treatment of strip material shown schematically in FIG. 1 comprises an enclosure 1 having two vertical furnaces 2, 3 which form a first half of the apparatus and two other vertical furnaces 4, 5 similar to the two preceding furnaces, and which form the second half of the apparatus. The two first furnaces have a common vertical wall or partition 6, and in a similar manner, the two other furnaces have a common vertical wall or partition 7. The strip material 11 to be treated passes vertically and successively upwardly and downwardly, within the four furnaces, being guided by rollers 12, 13, 14, 15, 16, 17, 18, 19.

Each furnace, for example, the furnace 2, (see also FIG. 2) is made up of two vertical ducts 22, 23 separated by a space 24 through which the material 11 passes. The three other furnaces 3, 4, 5 similarly have ducts 25, 26; 27, 28; 29, 30 respectively, as well as spaces 31, 32, 33 respectively.

In each of the spaces between the two vertical ducts of a furnace, for example in the space 31 between the two ducts 25, 26 of the second furnace 3, there are arranged, in alternate pairs, nozzles 36 or 37, the material 11 to be treated passing between the two nozzles of each pair which are open on their opposed vertical faces. There are shown two nozzles 36 fixed in a cantilever fashion on the lower part of the duct 25 and communicating therewith; the other pairs of identical nozzles (not shown) are arranged vertically spaced on the duct 25. There is also shown one pair of nozzles 37 fixed in cantilever fashion on the upper part of the duct 26 and communicating therewith; other pairs of identical nozzles (not shown) are arranged vertically spaced on the duct 26, the material 11 thus passing successively between two nozzles carried by the duct 25 and two nozzles carried by the duct 26.

The bottom of the ducts of the two first furnaces 2, 3 are closed off, but their upper parts are connected to the fans, in the following manner:

The outlet of a blowing fan V1 is connected to the upper part of the ducts 22 and 25 of the two first furnaces, respectively whereas the upper part of the two other ducts 23 and 26 of these two furnaces is connected to the inlet of an exhaust fan E1.

In a similar fashion, the upper parts of the two ducts 27, 29 (FIG. 3) of the two furnaces 4 and 5 are connected to the outlet of a blowing fan V2, whereas the upper parts of the two other ducts 28 and 30 of these two furnaces are connected to the inlet of an exhaust fan E2.

It should be noted that the bottom of the two ducts 29, 30 of the last furnace 5 is not completely shut off, but, on the contrary, they are connected respectively to a blowing fan V3 and an exhaust fan E3.

Also, a second outlet of the fan V1 (FIG. 2) is connected to the inlet of the exhaust fan E1 by a bypass conduit 41 and the outlets of the two other blowing fans V2, V3 (FIG. 3) are connected respectively to the inlets of the two other exhaust fans E2, E3 by two bypass conduits 42 and 43, respectively. On these three bypass conduits 41, 42, 43 there are mounted three baffles 46, 47, 48, respectively, controlled, for example, by corresponding compressed air pistons or membrane motors 46A, 47A, 48A subjected to the action of the pressure which exists in the corresponding ducts 22, 25, 27, 29.

The air used in the two first furnaces 2, 3 (FIG. 2) is heated by a burner 51 the outlet of which is connected to the inlet of fan V1 by a conduit 52 and to the upper part of the ducts 23, 26, by a conduit 53. Similarly, the air used in the two last furnaces 4, 5 is heated by a burner 54 the outlet of which is connected to the inlet of fan V2 by a conduit 56 and to the upper part of the two ducts 28, 30 by a conduit 36. On the conduits 53 and 56 there are mounted baffles 61, 62, respectively.

The apparatus includes the following further baffles:

(a) For the first half of the apparatus (FIG. 2):

Baffle 65 on the outlet of blowing fan V1 feeding the two ducts 22, 25, Baffle 66 on the branch which feeds only the duct 22, Baffle 67 on the upper outlet conduit of the duct 23, Baffle 68 on a third outlet of the blowing ventilator V1, Baffle 69 on an atmosphere vented outlet of blowing fan V1, (b) For the second part of the apparatus (FIG. 3):

Baffle 75 on the outlet of blowing fan V2 feeding the two ducts 27, 29, Baffle 76 on the branch which feeds the duct 27, Baffle 77 on the upper outlet conduit of the duct 28, Baffle 78 on a third outlet of the blowing fan V2, Baffle 79 on an atmosphere vented outlet of the blowing fan V2.

All the baffles which have been listed above are, for example, controlled by pneumatic pistons.

Figure 4:
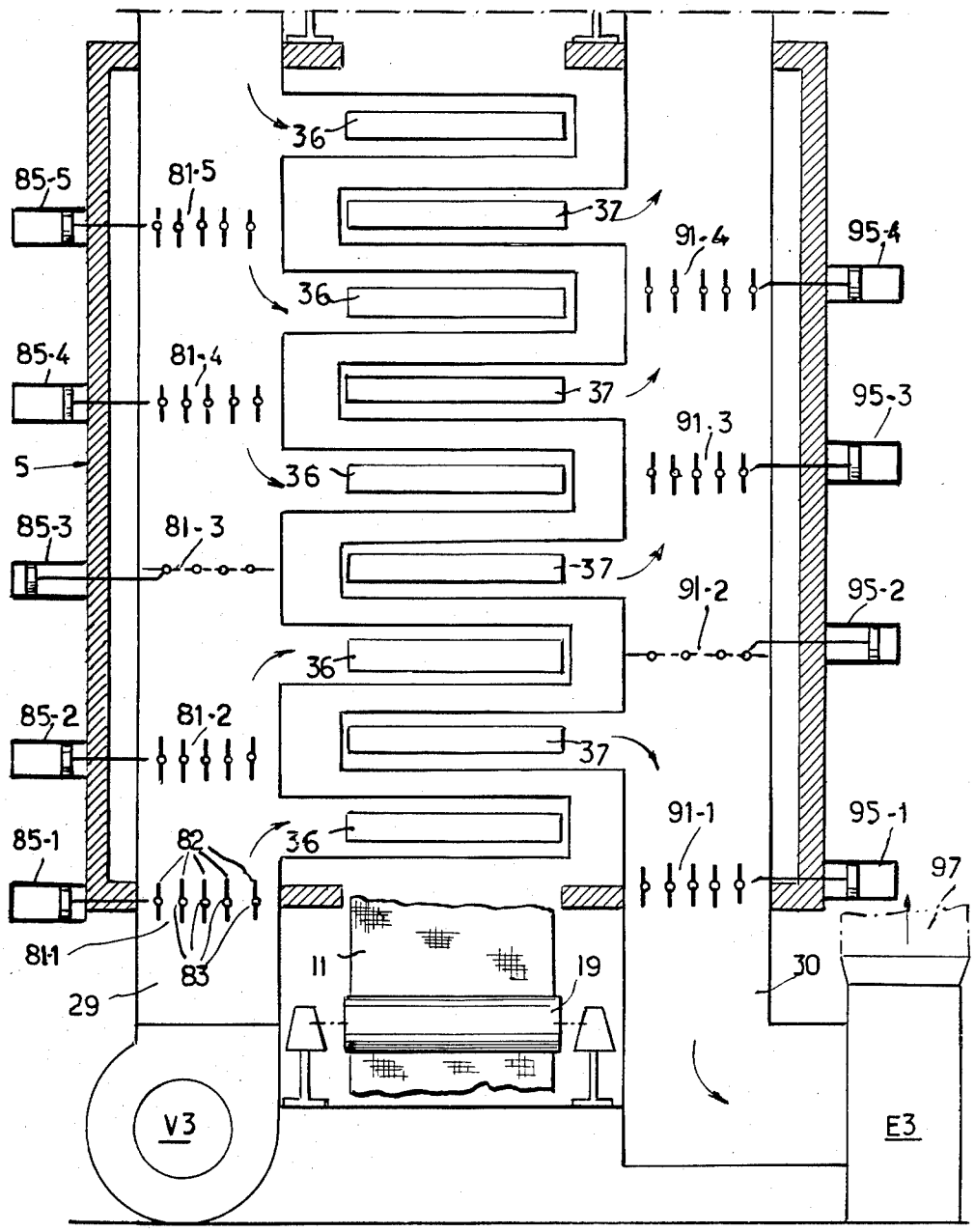
FIG. 4, is, to a greater scale, a vertical front section of the second furnace of the second half of the apparatus taken along the line IV—IV of FIG. 3.

In the apparatus shown in the drawings, the three first furnaces 2, 3, 4 serve to heat the material, throughout their height, whereas the fourth furnace 5, in its upper part, still heats the material, but, in its lower part, serves to cool it. The height of the lower cooling part is controllable as desired by virtue of a system of selective horizontal baffles shown in FIG. 4. This system includes a certain number (5 in the example) of baffles 81-1, 81-2, 81-3, 81-4, 81-5 distributed throughout the height of the duct 29 of the last furnace 5, and a certain number (4 in the example) of identical baffles 91-1, 91-2, 91-3, 91-4 distributed throughout the height of the other duct 30 of the same furnace.

Each of these baffles, for example the baffle 81-1, is made up of several (again 5 in the example) butterfly-valves 82 pivotally mounted, one next to the other, on parallel horizontal axes 83. When the butterfly-valves are in a vertical position, as is the case of the baffles 81-1, 81-2, 81-4 and 81-5 on the drawing, they effectively do not impede the passage of gases, whereas when they are in a horizontal position, they form effective horizontal partitions which are substantially continuous and which block the duct at the corresponding level. Thus, in the example, the baffle 81-3 divides the duct 29 into two parts with regard to height, the upper part being arranged to receive warm air and the lower part cool air. In a similar manner, in the example, only the baffle 91-2 is closed and forms a horizontal partition which divides the duct 30 into an upper part and a lower part. The baffles arranged within the duct 30 are slightly offset in height relative to those which are arranged in the duct 29, corresponding to the nozzles 37 and 36 alternately mounted on one or other duct. All these horizontal butterfly-valve baffles are also controlled, in the example, by pneumatic pistons 85-1, 85-2, . . . 85-5 and 95-1, 95-2, . . . 95-4, respectively.

The operation of the apparatus is as follows:

The material 11 enters the base of the furnace 2 and is subjected to a treatment of hot air blown by the nozzles 36 of the duct 22, the moisture or solvent carrying air being withdrawn by the nozzles 37 carried by the duct 23 from whence it is sucked and blown out by the exhaust fan E1. The material thence passes successively over rollers 13, 14 and passes down the second furnace 3 where it is subjected to a similar heat treatment. It then passes over rollers 15, 16 to pass again up through the third furnace 4 in which it is yet again subjected to a similar treatment. The material then passes over rollers 17, 18 and passes down the fourth furnace 5 in the upper part of which, that is to say, above the level of the closed horizontal baffles 91-2, it is again subjected to hot air treatment. After this, below this level, it is subjected only to the action of cold air. By selective operation of the horizontal baffles 81-1 to 81-5 and 91-1 to 91-4 one can control, as desired, the positioning of the separation level between the hot air treatment and cold air treatment within the fourth furnace 5.

One can regulate the heat supply as a function of movement speed of the material within the apparatus by operation of the baffles 65, 66, 69 and 61, 67, 68 (FIG. 2) for the two first furnaces, and the corresponding baffles for the two other furnaces.

By closing the baffles 66 and 76, one can interrupt the blowing of hot air within the ducts 22 and 27, respectively, which allows adjustment of the supply of heat for selected periods of time. The moisture or solvent filled air is removed by the ducts 23, 26 (FIG. 2) and 28, 30 (FIG. 3) which are connected to exhaust fans E1 and E2, respectively.

The baffle 61 or 62 allows control of the supply of cold air.

The bypass conduits 41 and 42, provided with baffles 46 and 47, allow control of the quantity of warm gases, coming from burners 51, 54 which is passed to the ducts 22, 25 and 27, 29.

The cold air, blown by fan V3 (FIG. 3) in the lower part of the duct 29 of the fourth furnace 5 removes the heat from the material and passes through the lower part of the duct 30 under the effect of suction of the exhaust fan E3 from where it is discharged through a chimney 97.

The situation could arise that it is necessary to cool quickly the ambient air within the ducts in order to unravel, for example, coiled yarn, or to effect connection in the case of breakage of treated strip products. To this end, the baffle 65 of furnaces 2 and 3 is closed whereas the baffles 66, 67, 68, 69 are maintained open. The cold air sucked in by fan V1 passes through the baffle 69, duct 22, 25 the nozzles 36, 37 and through the bypass conduit 41, whilst the exhaust fan E1 remain operating. The same applies for rapid cooling of the other furnaces 4 and 5, by placing the corresponding baffles in similar conditions.

Clearly, the invention is not limited to the embodiments described and shown; numerous modifications may be added, according to the desired applications without departing from the scope of the invention.

Thus, for example, the apparatus can be adapted for the heat treatment of other continuous textile products as well as strip material for example yarn or ribbon.

What is claimed is:

1. Apparatus for heat treatment of continuous textile products, such as yarn, ribbon or strip material, comprising an arrangement of vertical furnaces through which the product successively passes, each furnace having two vertically extending horizontally spaced ducts defining a space therebetween, air blowing nozzles and suction nozzles alternately supported, in pairs, within said space by respective ducts and being connected to said ducts, the upper part of the ducts of a furnace being respectively connected to a blowing fan and to an exhaust fan, the last furnace having means adapted to constitute a height adjustable partition which divides each of the two ducts of this last furnace into an upper part for hot air treatment and a lower part for cold air treatment, said lower part being also equipped with a blowing fan and an exhaust fan, wherein said means is constituted by a series of horizontal first baffles distributed throughout the height of the corresponding duct and selectively operable such that one of said baffles in a closed position forms said movable partition, the other baffles being in an open position.

2. Apparatus as claimed in claim 1, wherein each of the said horizontal baffles is constituted by an array of butterfly-valves pivotally mounted on parallel horizontal axes, the shape and size of the butterfly-valves being such that, when all the butterfly-valves of a baffle are aligned in the closed position in the same horizontal plane, they together form an effective sealed partition, whereas the other baffles of the same duct are in an open position and do not offer any effective resistance to the passage of gases.

3. Apparatus as claimed in claim 2, and including bypass conduits each having a controllable baffle and connecting respective outlets of each blowing fan to the respective inlets of the corresponding exhaust fan.

4. Apparatus as claimed in claim 3, wherein said controllable baffles are controlled by compressed air pistons subjected to the action of the pressure which exits in the corresponding ducts.

5. Apparatus as claimed in claim 1, including second baffles connected to branches of the conduit which connects the outlet of each upper blowing fan to the corresponding ducts and which is vented to atmosphere, as well as third baffles connected to a second outlet of said fans and similarly vented to atmosphere, to allow rapid cooling of the said ducts.

6. Apparatus as claimed in claim 1, wherein each upper blowing fan is connected to several ducts by conduits, at least one of which is provided with a fourth baffle.

* * * * *